US006021583A

United States Patent [19]

Stelljes, Jr. et al.

[11] Patent Number: 6,021,583

[45] Date of Patent: Feb. 8, 2000

[54] LOW WET PRESSURE DROP LIMITING ORIFICE DRYING MEDIUM AND PROCESS OF MAKING PAPER THEREWITH

[75] Inventors: Michael Gomer Stelljes, Jr., West Chester; Paul Dennis Trokhan, Hamilton; Donald Eugene Ensign, Cincinnati, all of Ohio

[73] Assignee: The Procter & Gamble Company, Cincinnati, Ohio

[21] Appl. No.: 08/932,846

[22] Filed: Sep. 18, 1997

[51] Int. Cl.[7] ..... F25B 9/00

[52] U.S. Cl. ..... 34/618; 34/611; 34/116

[58] Field of Search ..... 34/155, 156, 160, 34/23, 123, 116, 243 R; 162/358, 361

[56] References Cited

U.S. PATENT DOCUMENTS

| | | | |
|---|---|---|---|
| Re. 28,459 | 7/1975 | Cole et al. . | |
| 3,121,660 | 2/1964 | Hall . | |
| 4,172,910 | 10/1979 | Rotar . | |
| 4,191,609 | 3/1980 | Trokhan . | |
| 4,251,928 | 2/1981 | Rotar et al. . | |
| 4,329,201 | 5/1982 | Bolton . | |
| 4,528,239 | 7/1985 | Trokhan . | |
| 4,556,450 | 12/1985 | Chuang et al. . | |
| 4,583,302 | 4/1986 | Smith . | |
| 4,888,096 | 12/1989 | Cowan et al. | 162/358 |
| 4,921,750 | 5/1990 | Todd . | |
| 4,942,675 | 7/1990 | Sundovist . | |
| 4,973,385 | 11/1990 | Jean et al. . | |
| 5,274,930 | 1/1994 | Ensign et al. . | |
| 5,543,107 | 8/1996 | Ensign et al. . | |
| 5,584,126 | 12/1996 | Ensign et al. . | |
| 5,584,128 | 12/1996 | Ensign et al. . | |
| 5,598,643 | 2/1997 | Chuang et al. . | |
| 5,629,052 | 5/1997 | Trokhan et al. . | |

FOREIGN PATENT DOCUMENTS

| | | |
|---|---|---|
| 0 211 471 | 2/1987 | European Pat. Off. . |
| WO 94/00636 | 1/1994 | WIPO . |

OTHER PUBLICATIONS

Articles from Haver & Boecker Woven Wire Cloth Reference Book No. 87, 1990 Edition, pp. 42–49.

*Primary Examiner*—Henry Bennett
*Assistant Examiner*—Malik N. Drake
*Attorney, Agent, or Firm*—Larry L. Huston; Donald E. Hase; E. Kelly Linman

[57] ABSTRACT

An apparatus for drying a cellulosic fibrous structure. The apparatus comprises a micropore medium having pores therethrough. The pores are the limiting orifice in the air flow used in the drying process. The micropore medium has a relatively low wet pressure drop therethrough. This relatively low wet pressure drop advantageously reduces the energy costs used in drying, and/or allows for greater drying to be obtained at constant energy costs.

13 Claims, 3 Drawing Sheets

LOW WET PRESSURE DROP LIMITING ORIFICE DRYING MEDIUM AND PROCESS OF MAKING PAPER THEREWITH

FIELD OF THE INVENTION

The present invention relates to an apparatus for absorbent embryonic webs which are through air dried to become a cellulosic fibrous structure and particularly to an apparatus which provides an energy savings during the through air drying process.

BACKGROUND OF THE INVENTION

Absorbent webs include cellulosic fibrous structures, absorbent foams, etc. Cellulosic fibrous structures have become a staple of everyday life. Cellulosic fibrous structures are found in facial tissues, toilet tissues and paper toweling.

In the manufacture of cellulosic fibrous structures, a slurry of cellulosic fibers dispersed in a liquid carrier is deposited onto a forming wire to form an embryonic web. The resulting wet embryonic web may be dried by any one of or combinations of several known means, each of which drying means will affect the properties of the resulting cellulosic fibrous structure. For example, the drying means and process can influence the softness, caliper, tensile strength, and absorbency of the resulting cellulosic fibrous structure. Also the means and process used to dry the cellulosic fibrous structure affects the rate at which it can be manufactured, without being rate limited by such drying means and process.

An example of one drying means is felt belts. Felt drying belts have long been used to dewater an embryonic cellulosic fibrous structure through capillary flow of the liquid carrier into a permeable felt medium held in contact with the embryonic web. However, dewatering a cellulosic fibrous structure into and by using a felt belt results in overall uniform compression and compaction of the embryonic cellulosic fibrous structure web to be dried. The resulting paper is often stiff and not soft to the touch.

Felt belt drying may be assisted by a vacuum, or may be assisted by opposed press rolls. The press rolls maximize the mechanical compression of the felt against the cellulosic fibrous structure. Examples of felt belt drying are illustrated in U.S. Pat. No. 4,329,201 issued May 11, 1982 to Bolton and U.S. Pat. No. 4,888,096 issued Dec. 19, 1989 to Cowan et al.

Drying cellulosic fibrous structures through vacuum dewatering, without the aid of felt belts is known in the art. Vacuum dewatering of the cellulosic fibrous structure mechanically removes moisture from the cellulosic fibrous structure while the moisture is in the liquid form. Furthermore, if used in conjunction with a molding template-type belt, the vacuum deflects discrete regions of the cellulosic fibrous structure into the deflection conduits of the drying belts and strongly contributes to having different amounts of moisture in the various regions of the cellulosic fibrous structure. Similarly, drying a cellulosic fibrous structure through vacuum assisted capillary flow, using a porous cylinder having preferential pore sizes is known in the art as well. Examples of such vacuum driven drying techniques are illustrated in commonly assigned U.S. Pat. No. 4,556,450 issued Dec. 3, 1985 to Chuang et al. and U.S. Pat. No. 4,973,385 issued Nov. 27, 1990 to Jean et al.

In yet another drying process, considerable success has been achieved drying the embryonic web of a cellulosic fibrous structure by through-air drying. In a typical through-air drying process, a foraminous air permeable belt supports the embryonic web to be dried. Hot air flow passes through the cellulosic fibrous structure, then through the permeable belt or vice versa. The air flow principally dries the embryonic web by evaporation. Regions coincident with and deflected into the foramina in the air permeable belt are preferentially dried. Regions coincident the knuckles in the air permeable belt are dried to a lesser extent by the airflow.

Several improvements to the air permeable belts used in through-air drying have been accomplished in the art. For example, the air permeable belt may be made with a high open area, i.e., at least forty percent. Or, the belt may be made to have reduced air permeability. Reduced air permeability may be accomplished by applying a resinous mixture to obturate the interstices between woven yarns in the belt. The drying belt may be impregnated with metallic particles to increase its thermal conductivity and reduce its emissivity or, alternatively, the drying belt may be constructed from a photosensitive resin comprising a continuous network. The drying belt may be specially adapted for high temperature airflows, of up to about 815 degrees C. (1500 degrees F). Examples of such through-air drying technology are found in U.S. Patent Re. 28,459 reissued Jul. 1, 1975 to Cole et al.; U.S. Pat. No. 4,172,910 issued Oct. 30, 1979 to Rotar; U.S. Pat. No. 4,251,928 issued Feb. 24, 1981 to Rotar et al.; commonly assigned U.S. Pat. No. 4,528,239 issued Jul. 9,1985 to Trokhan, incorporated herein by reference; and U.S. Pat. No. 4,921,750 issued May 1, 1990 to Todd. Additionally, several attempts have been made in the art to regulate the drying profile of the cellulosic fibrous structure while it is still an embryonic web to be dried. Such attempts may use either the drying belt, or an infrared dryer in combination with a Yankee hood. Examples of profiled drying are illustrated in U.S. Pat. No. 4,583,302 issued Apr. 22, 1986 to Smith and U.S. Pat. No. 4,942,675 issued Jul. 24, 1990 to Sundovist.

The foregoing art, even that specifically addressed to through-air drying, does not address the problems encountered when drying a multi-region cellulosic fibrous structure. For example, a first region of the cellulosic fibrous structure, having a lesser absolute moisture, density or basis weight than a second region, will typically have relatively greater airflow therethrough than the second region. This relatively greater airflow occurs because the first region of lesser absolute moisture, density or basis weight presents a proportionately lesser flow resistance to the air passing through such region.

This problem is exacerbated when a multi-region, multi-elevational cellulosic fibrous structure to be dried is transferred to a Yankee drying drum. On a Yankee drying drum, isolated discrete regions of the cellulosic fibrous structure are in intimate contact with the circumference of a heated cylinder and hot air from a hood is introduced to the surface of the cellulosic fibrous structure opposite the heated cylinder. However, typically the most intimate contact with the Yankee drying drum occurs at the high density or high basis weight regions. After some moisture is removed from the cellulosic fibrous structure, the high density or high basis weight regions are not as dry as the low density or low basis weight regions. Preferential drying of the low density regions occurs by convective transfer of the heat from the airflow in the Yankee drying drum hood. Accordingly, the production rate of the cellulosic fibrous structure must be slowed, to compensate for the greater moisture in the high density or high basis weight region. To allow complete drying of the high density and high basis weight regions of the cellulosic fibrous structure to occur and to prevent scorching or burning of the already dried low density or low basis weight regions by the air from the hood, the Yankee hood air temperature must be decreased and the residence time of the cellulosic fibrous structure in the Yankee hood must be increased, slowing the production rate.

Another drawback to the approaches in the prior art (except those that use mechanical compression, such as felt belts) is that each relies upon supporting the cellulosic fibrous structure to be dried. Air first flows through the cellulosic fibrous structure and then through the supporting belt, or, alternatively, first flows through the drying belt, and then the cellulosic fibrous structure. Differences in flow resistance through the belt or through the cellulosic fibrous structure amplify differences in moisture distribution within the cellulosic fibrous structure, and/or creates differences in moisture distribution where none previously existed.

One improvement in the art which addresses this problem is illustrated by commonly assigned U.S. Pat. No. 5,274,930 issued Jan. 4, 1994 to Ensign et al. and disclosing limiting orifice drying of cellulosic fibrous structures in conjunction with through-air drying, which patent is incorporated herein by reference. This patent teaches an apparatus utilizing a micropore drying medium which has a greater flow resistance than the interstices between the fibers of the cellulosic fibrous structure. The micropore medium is therefore the limiting orifice in the through-air drying process so that an equal, or at least a more uniform, moisture distribution is achieved in the drying process.

Yet other improvements in the art which address the drying problems are illustrated by commonly assigned U.S. Pat. No. 5,543,107 issued Aug. 1, 1995 to Ensign et al.; U.S. Pat. No. 5,584,126 issued Dec. 19, 1996 to Ensign et al.; and U.S. Pat. No. 5,584,128 issued Dec. 17, 1996 to Ensign et al., the disclosures of which patents are incorporated herein by reference. The Ensign et al. '126 and Ensign et al. '128 patents teach multiple zone limiting orifice apparatuses for through air drying cellulosic fibrous structures. However, Ensign et al. '126, Ensign et al. '128, and Ensign et al. '930 do not teach how to minimize pressure drop through the micropore drying medium when encountering liquid or two phase flow. The magnitude of the pressure drop is important. As the pressure drop, at a given flow rate, through the medium decreases, less horsepower is necessary to run the fan(s) which draw air through the apparatus. Reducing fan horsepower is an important source of energy savings. Conversely, at equivalent horsepower and pressure drop, additional airflow can be drawn through the cellulosic fibrous structure, thereby improving the drying rate. The improved drying rate allows for increased throughput in the papermaking machine.

The limiting orifice through-air-drying apparatus of the Ensign et al. '107 patent teaches having one or more zones with either a subatmospheric pressure or a positive pressure to promote flow in either direction.

Applicants have unexpectedly found a way to treat the micropore drying media of the prior art apparatuses to reduce pressure drop at a constant liquid or two phase flow, or, alternatively, increase liquid or two phase flow at constant pressure drop. Furthermore, it has unexpectedly been found that this invention can be retrofitted to the micropore drying apparatus of the prior art without significant rebuilding.

The apparatus of the present invention may be used to make paper. The paper may be through air dried. If the paper is to be through air dried, it may be through air dried as described in commonly assigned U.S. Pat. No. 4,191,609, issued Mar. 4, 1980 to Trokhan; or the aforementioned U.S. Pat. No. 4,528,239, the disclosures of which patents are incorporated herein by reference. If the paper is conventionally dried, it may be conventionally dried as described in commonly assigned U.S. Pat. No. 5,629,052, issued May 13, 1997to Trokhan et al., the disclosure of which patent is incorporated herein by reference.

Accordingly, it is an object of this invention to provide a limiting orifice through-air drying apparatus having a micropore medium which can be used to produce cellulosic fibrous structures. It is, furthermore, an object of this invention to provide a limiting orifice through-air drying apparatus which reduces the necessary residence time of the embryonic web thereon and/or requires less energy than had previously been thought in the prior art. Finally, it is an object of this invention to provide a limiting orifice through-air drying apparatus having a micropore medium which is usable with a relevant prior art apparatus, which apparatus preferably is or has at least one zone with a differential pressure greater than the breakthrough pressure.

SUMMARY OF THE INVENTION

The invention comprises a micropore medium. The micropore medium may be used with a through air drying papermaking apparatus, and may further be the limiting orifice for air flow therethrough. The micropore medium has a wet pressure drop therethrough at a flow rate of 40 scfm per 0.087 square feet of less than or equal to 4.0 inches of Mercury. As the flow rate increases to 60 and 80 scfm per 0.087 square feet, the wet pressure drop therethrough increases to values less than or equal to 5.0 and 6.0 inches of Mercury, respectively.

The relationship between the flow rate and the pressure drop is given by the general formula that the wet pressure drop in inches of Mercury is less than or equal to 0.048 times the flow rate in scfm per 0.087 square feet+2.215.

Another aspect of the invention comprises making paper with the micropore medium. The paper is made by providing an embryonic web, and providing a micropore medium having a predetermined pore size. The pore size is the limiting orifice for air flow through the embryonic web. The pore size is preferably less than or equal to 20 microns. The micropore medium also has a wet pressure drop therethrough. The wet pressure drop increases with increasing flow rate through the medium.

The embryonic web is disposed on the micropore medium. Air is passed through the embryonic web and the micropore medium whereby the air encounters a wet pressure drop upon passing at a predetermined flow rate through the embryonic web and the medium. The flow rate and the wet pressure drop are related by the general formula $$Y \leqq 0.048X+2.215$$

wherein Y is the wet pressure drop in inches of Mercury and X is the flow rate in scfm per 0.087 square feet. The general formula holds throughout the range of flow rates from about 35 to about 95 scfm per 0.087 square feet, and more particularly throughout the range of about 40 to about 80 scfm per 0.087 square feet.

DETAILED DESCRIPTION OF THE INVENTION

Figure 1:
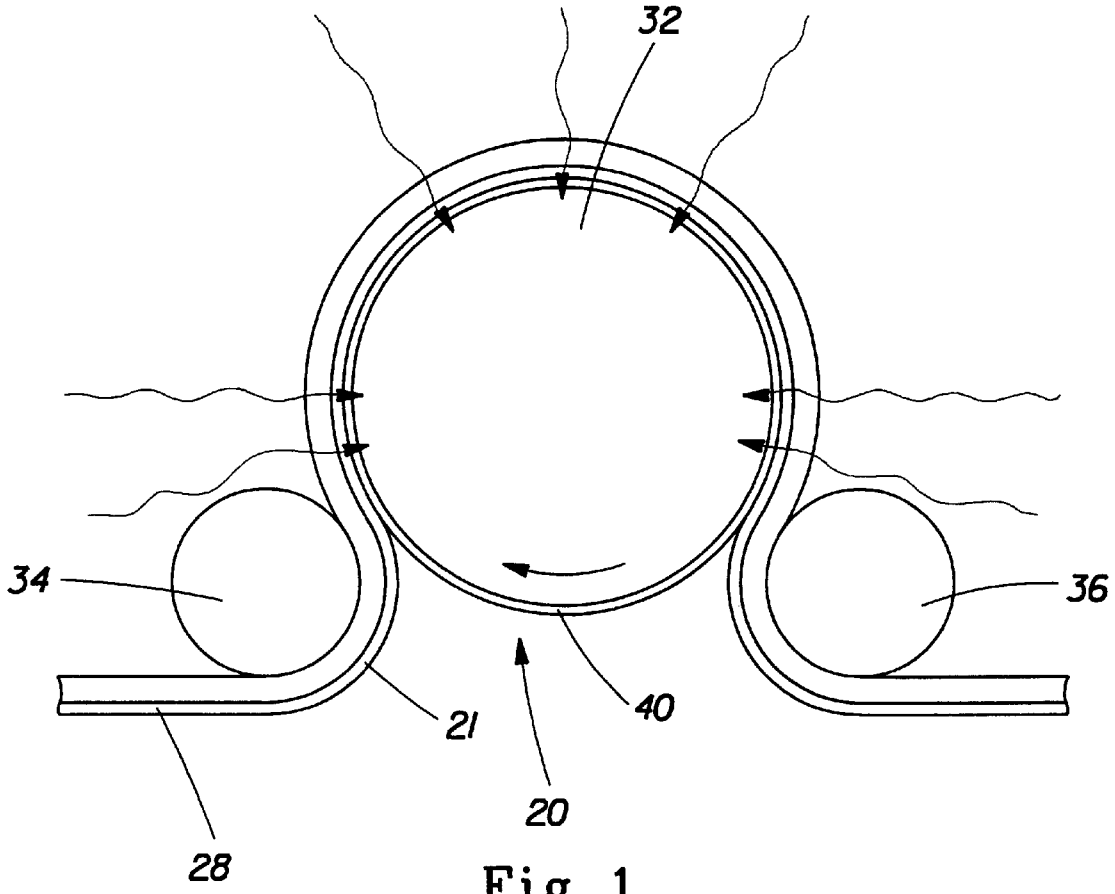
FIG. 1 is a schematic side elevational view of a micropore medium according to the present invention embodied on a pervious cylinder, the thickness being exaggerated for clarity.

Referring to FIG. 1, the present invention comprises a limiting orifice though-air-drying apparatus 20 in conjunction with a micropore medium 40. The apparatus 20 and medium 40 may be made according to the aforementioned U.S. Pat. Nos. 5,274,930; 5,543,107; 5,584,126; 5,584,128; and commonly assigned U.S. patent application Ser. No. 08/878,794, filed Jun. 16, 1997 in the names of Ensign et al., the disclosures of which are incorporated herein by reference. The apparatus 20 comprises a pervious cylinder 32. The micropore medium 40 may circumscribe the pervious cylinder 32. A support member 28, such as a through-air-drying belt or press felt, wraps the pervious cylinder 32 from an inlet roll 34 to a takeoff roll 36, subtending an arc defining a circular segment. This circular segment may be subdivided into multiple zones having mutually different differential pressures relative to the atmospheric pressure. Alternatively, the apparatus 20 may comprise a partitioned vacuum slot, flat or arcuate plates, or an endless belt. The apparatus 20 removes moisture from an embryonic web 21.

Figure 2:
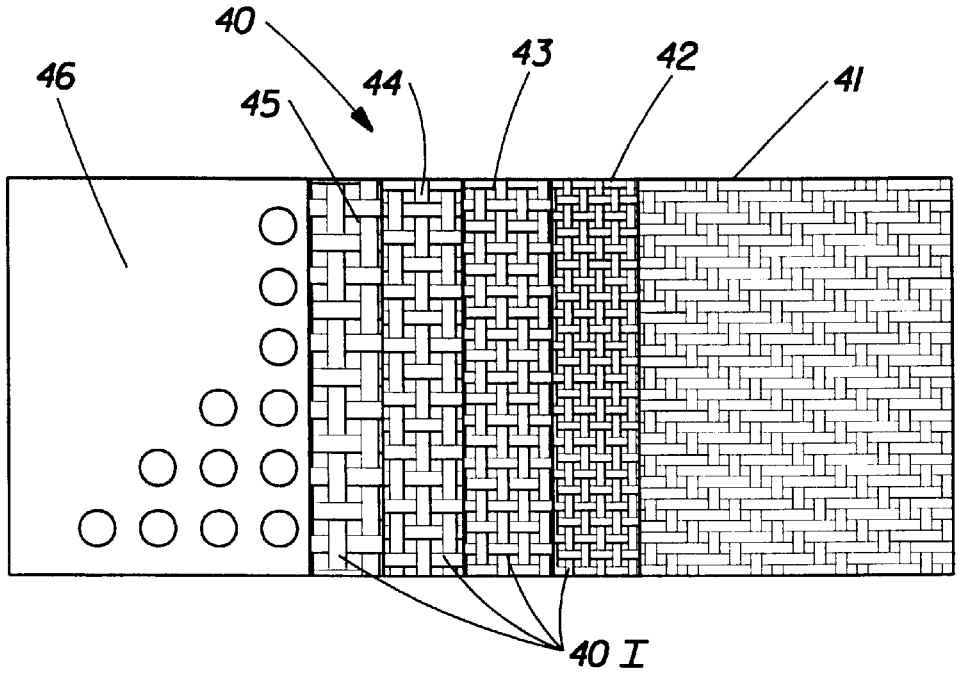
FIG. 2 is a fragmentary top plan view of a micropore medium according to the present invention showing the various laminae.

Referring to FIG. 2, the micropore drying medium 40 according to the present invention comprises a plurality of laminae 41–46. The micropore medium 40 according to the present invention may have a first lamina 41 which is closest to and contacts the embryonic web 21. Preferably the first lamina 41 is woven, and more preferably woven with a Dutch twill or BMT ZZ weave.

Subjacent the first lamina 41 may be one or a plurality of other laminae 42–46. The subjacent laminae 42–46 provide support for the laminae 41–45 and flexural fatigue strength. The laminae 41–46 may have an increasing pore size for the removal of water therethrough, as the subjacent laminae 42–46 are approached. At least the first lamina 41 and more particularly, the pores on the surface which contacts the embryonic web 21, has the low surface energy described below. Alternatively, other and all of the laminae 41–46, comprising the medium 40 according to the present invention may be treated to have the low surface energy described below. Although six laminae 41–46 are shown in FIG. 2, one of ordinary skill will recognize any suitable number may be utilized in the medium 40.

The laminae 41–46 each have two surfaces, a first surface and a second surface opposed thereto. The first and second surfaces are in fluid communication with each other by pores therebetween.

The medium 40 according to the present invention has a pore size of less than or equal to 20 microns. The medium 40 further has a wet pressure drop at 40 scfm per 0.087 square feet, of less than 4.0, preferably less than 3.5, and more preferably less than 3.0 inches of Mercury. The medium 40 according to the present invention further has a wet pressure drop at 60 scfm per 0.087 square feet, of less than 5.0, preferably less than 4.5, and more preferably less than 4.0 inches of Mercury. The medium 40 according to the present invention further has a wet pressure drop at 80 scfm per 0.087 square feet, of less than 6.0, preferably less than 5.5, and more preferably less than 5.0 inches of Mercury. These characteristics of the medium 40 according to the present invention are shown in Table I.

TABLE I

| Flow Rate (scfm/0.087 sq. ft.) | 40 | 60 | 80 |
|---|---|---|---|
| Maximum Wet Pressure Drop (inches of Mercury) | 4.0 | 5.0 | 6.0 |
| Preferred Wet Pressure Drop (inches of Mercury) | 3.5 | 4.5 | 5.5 |
| More Preferred Wet Pressure Drop (inches of Mercury) | 3.0 | 4.0 | 5.0 |

As used herein, scfm refers to the flow rate of a standard cubic foot of air at 70° F. and 29.92 inches of Mercury.

Figure 4:
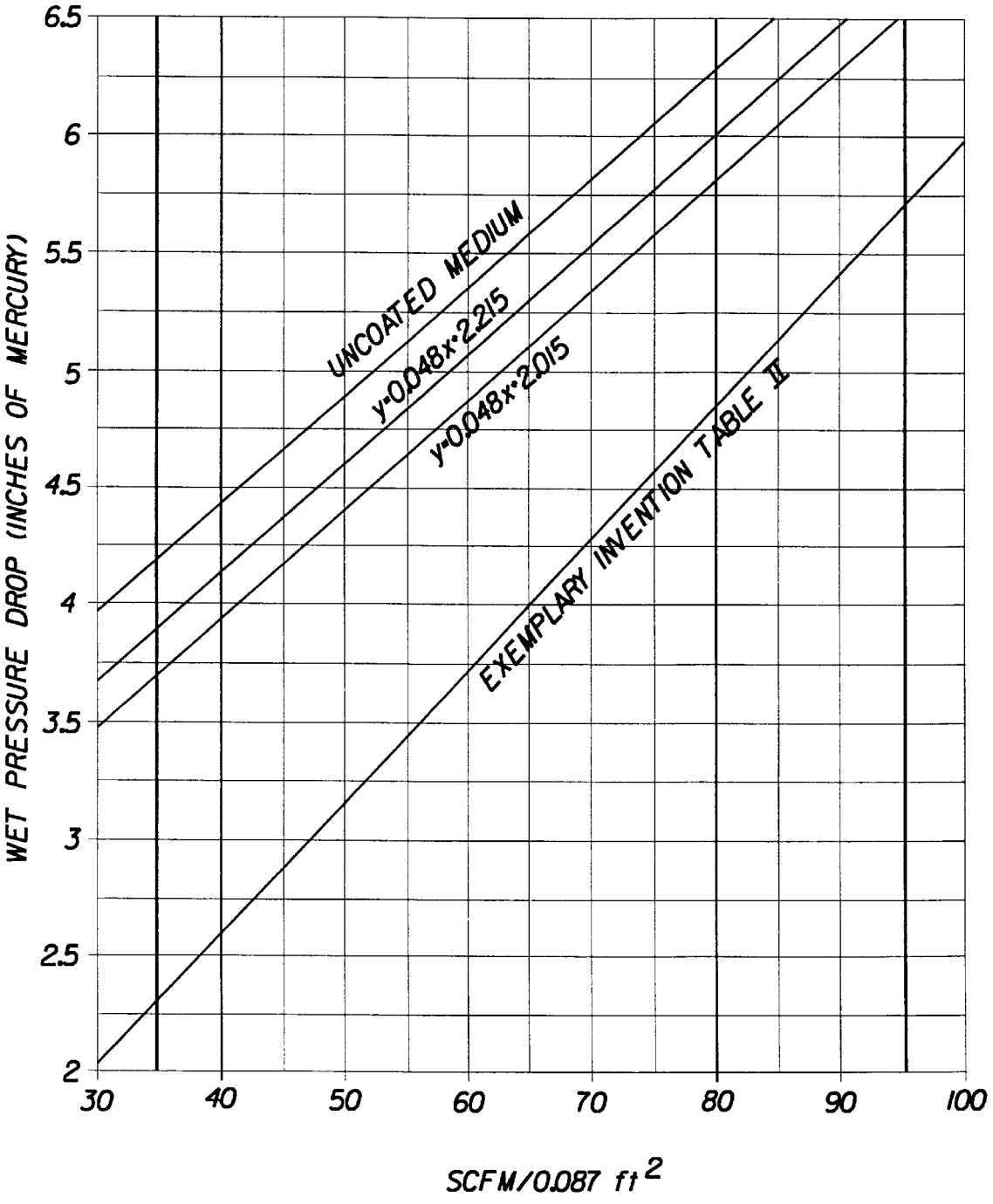
FIG. 4 is a graphical representation of the relationships between flow rate and wet pressure drop.

Referring to FIG. 4, the relationship between flow rate and wet pressure drop can be approximated as a linear relationship over the range of flow rates ranging from 40 to 80 scfm per 0.087 square feet, and for certain values can be approximated by a linear relationship from flow rates ranging from 35 to 95 scfm per 0.087 square feet. Particularly, the relationship between pressure drop and flow rate is given by the formula:

$$Y \leqq 0.048X + 2.215, \text{ and more preferably}$$

$$Y \leqq 0.048X + 2.015,$$

wherein X is the flow rate in scfm per 0.087 square feet, and

Y is the wet pressure drop in inches of Mercury.

The drying performance of an exemplary medium 40 according to the present invention was compared to an uncoated medium 40. To make the test condition even more rigorous, a finer pore size was utilized in the first lamina 41 of the medium 40 according to the present invention than in the first lamina 41 of the uncoated medium 40. Particularly, the medium 40 according to the present invention utilized a medium 40 having a 200×1400 Dutch twill weave, coated with KRYTOX DF as described above for the first lamina 41. The uncoated medium 40 had a 165×1400 Dutch twill woven first lamina 41.

Both media 40 were tested for sheet consistency at different drying residence times with an embryonic web thereon. The test was run at a constant wet pressure drop of 4.3 inches of Mercury. At a residence time of 50 milliseconds, consistency increased 2 percentage points. As the residence time increased to 150 milliseconds, consistency increased 7 percentage points. As the residence time increased to 250 milliseconds, consistency increased 9 percentage points. These results are shown in Table II.

TABLE II

| Residence Time (milliseconds) | Consistency Increase Over An Uncoated Medium (percentage points) |
|---|---|
| 50 | 2 |
| 150 | 7 |
| 250 | 9 |

It can be seen the present invention advantageously improves drying throughout a range of residence times.

Referring to FIG. 2, the relatively low pressure drop according to the present invention may be provided as follows. The first surface, i.e., that which is oriented towards the high pressure or upstream side of the air flow or water flow therethrough, should have a low surface energy according to the present invention and as described below. Also, the pores between the first and second surfaces, particularly those pores which provide limiting orifices in the flow path, should also be provided with a low surface energy surface as described below.

The low surface energy may be accomplished with a surface coating. The coating may be applied after the laminae 41–46 are joined together and sintered, to prevent the deleterious effects of the manufacturing operation on the coating or deleterious effects of the coating on the manufacturing operation.

According to the present invention, the medium 40 is coated in order to reduce pressure drop therethrough for liquid or two phase flow. Particularly, the coating reduces the surface energy of the medium 40, making it more hydrophobic. Any coating or other treatment which reduces the surface energy of the micropore medium 40 is suitable for use with the present invention, although coating the first lamina 41 of the micropore drying medium 40 has been found to be a particularly effective way to reduce the surface energy. Preferably, the surface energy is reduced to less than 46, preferably to less than 36, and more preferably to less than 26 dynes per centimeter.

The surface energy refers to the amount of work necessary to increase the surface area of a liquid on a solid surface. Generally, for solid surfaces, the cosine of the contact angle of a liquid thereon is a monotonic function of the surface tension of the liquid. As the contact angle approaches zero, the surface is more wetted. If the contact angle becomes zero, the solid surface is perfectly wetted. As the contact angle approaches 180 degrees, the surface approaches a non-wettable condition. It is to be recognized that neither zero nor 180 degree contact angles are observed with water, as may be used in the liquid slurry with the present invention. As used herein surface energy refers to the critical surface tension of the solid surface, and may be empirically found through extrapolation of the relationship between the surface tension of a liquid and its contact angle on a particular surface of interest. Thus, the surface energy of the solid surface is indirectly measured through the surface tension of a liquid thereon. Further discussion of surface energy is found in the Adv. Chem Ser No. 43 (1964) by W. A. Zisman and in Physical Chemistry of Surfaces, Fifth Edition, by Arthur W. Adamson (1990), both of which are incorporated herein by reference.

The surface energy is measured by low surface tension solutions (e.g., isopropanol/water or methanol/water mixtures). Particularly, the surface energy may be measured by applying a calibrated dyne pen to the surface of the medium 40 under consideration. The application should be at least one inch long to ensure a proper reading is obtained. The surface is tested at a temperature of 70°±5° F. Suitable dyne pens are available from the Control-Cure Company of Chicago, Ill.

Alternatively, a goniometer may be used, provided that one corrects the results for the surface topography of the laminae 41–46. Generally, as the surface becomes rougher, the apparent contact angle will be less than the true contact angle. If the surface becomes porous, such as occurs with the laminae 41–46 of the present invention, the apparent contact angle is larger than the true contact angle due to the increased liquid-air contact surface.

Nonlimiting and illustrative examples of suitable coatings useful to reduce the surface energy include both fluids and dry film lubricants. Suitable dry film lubricants include fluorotelomers, such as KRYTOX DF made by the DuPont Corporation of Wilmington, Del. The dry film lubricant may be dispersed in fluorinated solvents from the freon family, such as 1,1-dicholoro-1-fluoroethane, or 1,1,2-trichloro-1,2,2-trifluoroethane, or isopropyl alcohol, etc. The KRYTOX DF lubricant is preferably heat cured in order to melt the KRYTOX DF lubricant. Heat curing at 600 degrees F. for a period of 30 minutes has been found suitable or the medium 40 according to the present invention.

Alternatively, the coating material may comprise other low surface energy particles suspended in a liquid carrier. Prophetically, suitable particles include graphite and molybdenum disulfide.

Alternatively, the coating material may comprise a fluid. A polydimethylsiloxane fluid, such as GE Silicones DF 581 available from The General Electric Corporation of Fairfield, Conn. at one weight percent is a suitable fluid coating material. The polydimethylsiloxane fluid may be dispersed in isopropyl alcohol or hexane. Also, 2-ethyl-1-hexanol has also been found to be a carrier suitable for use with the present invention. After application to the medium 40, the polydimethylsiloxane is heat cured to increase its molecular weight via crosslinking and to evaporate the carrier. Curing for one hour at 500° F. has been found suitable for the medium 40 according to the present invention.

The coating materials, dry film or fluid, may be sprayed, printed, brushed, or rolled onto the medium 40. Alternatively, the medium 40 may be immersed in the coating material. A relatively uniform coating is preferred. The dry film coating material is preferably applied in relatively low concentrations, such as 0.5 to 2.0 weight percent. The low concentrations are believed to be important to prevent plugging of the small pores of the laminae 41–46 of the micropore medium 40. Silicone fluid coatings may be applied in concentrations of approximately 0.5 to 10 weight percent, and preferably 1 to 2 weight percent.

Prophetically, organically modified ceramic materials known as ormocers may be used to reduce the surface energy of the medium 40. Ormocers may be made according to the teachings of U.S. Pat. No. 5,508,095, issued Apr. 16, 1996, to Allum et al., and incorporated herein by reference. It will be apparent that various dry film lubricants, various fluid coatings, various ormocers, and combinations thereof may be used to reduce the surface energy of the medium 40.

If coatings are used to render the micropore drying medium 40 more hydrophobic and reduce its surface energy, it is important that the coatings do not plug the fine pores of the laminae 41–46, and particularly the first lamina 41 of the medium 40. The laminae 41–46, particularly the first lamina 41, may have pores with dimensions in any one direction less than or equal to 20 microns and even less than or equal to 10 microns. Pore size is determined by SAE ARP 901, the disclosure of which is incorporated herein by reference. The laminae 41–46 may have pores which successively increase in size from the first lamina 41 to the last lamina 46, the last lamina 46 being disposed furthest from the first lamina 41. The aforementioned dry film and fluid coatings have been successfully used without causing plugging of the laminae 41–46. A coating which significantly plugs the pores of the medium 40 is unsuitable. For example, a coating may be unsuitable, if the coating thickness and/or concentration is too great.

Rather than coating the surface of one or more laminae 41–46 of the medium 40 to reduce the surface energy as described above, prophetically the medium 40 could be made of a material intrinsically having a low surface energy. Although stainless steels have been described in the incorporated patents as suitable materials for the laminae 41–46, the laminae 41–46, particularly the first lamina 41, could be made of or impregnated with a low surface energy material such as tetrafluoroethylene, commonly sold by DuPont Corporation of Wilmington, Del. under the tradename TEFLON or low surface energy extruded plastics, such as polyesters or polypropylenes. It will be apparent that materials intrinsically having a relatively low surface energy may be coated as described above, to provide an even lower surface energy.

In yet another alternative embodiment, the apparatus 20 needs only to have a through-air drying zone and may eliminate the capillary drying zone. Such an apparatus 20 is believed useful in conjunction with the present invention In another variation, one of the intermediate laminae 42–45 may have the smallest pores therethrough. In this embodiment, the intermediate lamina 42–45 having the smallest pores will determine the flow resistance of the medium 40, rather than the first lamina 41. In such an embodiment, it is important that the intermediate laminae 42–45 having the greatest flow resistance be provided with the low surface energy described above. It will be recognized that, similar to the embodiments described above, the low surface energy surface need only be disposed on the high pressure (i.e., upstream) side and in the limiting orifice of the pores of that lamina 41–45.

Figure 3:
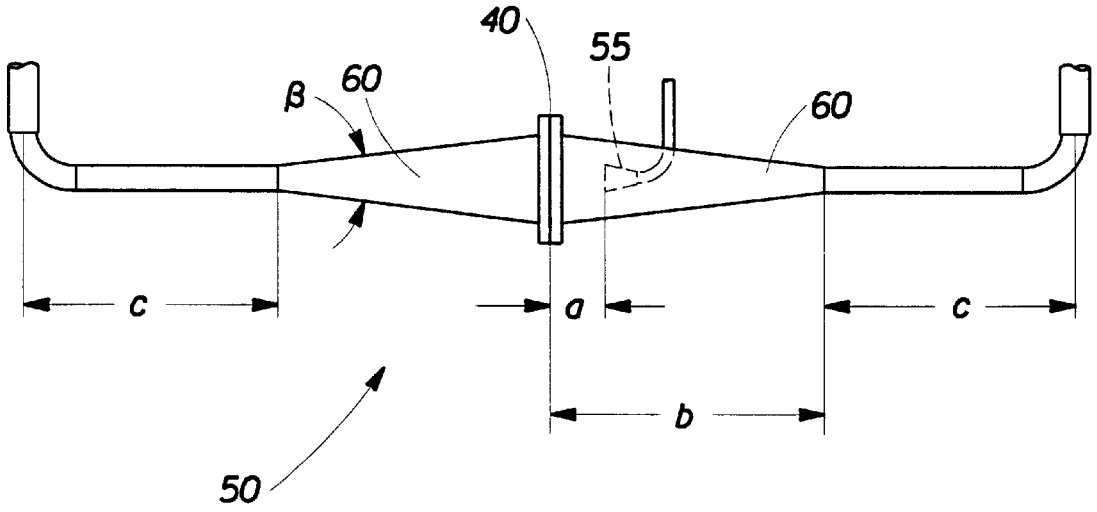
FIG. 3 is a schematic view of a fixture, useful in testing the present invention.

Referring to FIG. 3, dry pressure drop is measured as follows. A suitably sized sample of the medium 40 is provided so that a round, four inch diameter portion of the medium 40 may be exposed to flow therethrough. A test fixture 50 is also provided. The test fixture 50 comprises pipe having length c of 7 inches and having a two inch nominal diameter. The pipe then is joined to a reducer 60. The reducer has a length b of 16 inches and has a two inch nominal inside diameter. The inside diameter of the reducer 60 tapers at a 7 degree included angle β over a 16 inch length to a 4 inch nominal inside diameter.

The sample of the medium 40 is disposed at the 4 inch nominal inside diameter portion of the test fixture 50. The medium 40 is oriented so that the first ply 41 faces the high pressure (upstream) side of the airflow. The test fixture 50 is symmetrical about the sample of the medium 40.

Downstream of the sample of the medium 40 the test fixture 50 again tapers through a reducer 60 at an included angle β of 7 degrees from a 4 inch nominal inside diameter to a 2 inch nominal inside diameter. This reducer 60 is also joined to a pipe. This pipe has a length c of 7 inches is straight, and has a two inch nominal inside diameter.

Eight hundred scfm per square foot of air flow is applied through the medium 40, for a total of about 70 scfm per 0.087 square feet for the sample described herein. The air flow is maintained at 75±2° F. The static pressure across the medium 40 is measured by a manometer, a pair of pressure transducers, or other suitable means known in the art. This static pressure is the dry pressure drop for that medium 40.

In order to measure wet pressure drop, the apparatus and sample described above are provided. Additionally, a spray nozzle 55 is provided and mounted upstream of the sample of the medium 40. The spray nozzle 55 is a Spraying Systems (Cincinnati, Ohio) Type TG full cone spray nozzle 55 (¼ TTG 0.3) with a 0.020 inch orifice and 100 mesh screen or equivalent. The nozzle 55 is mounted at a distance a 5 inches upstream of the sample of the medium 40. The nozzle 55 supplies 0.06 gpm of water at 40 psi at a 58 degree full cone spray angle. The water is sprayed at a temperature of 72±2° F. This spray completely covers the sample of the medium 40 and increases the pressure drop therethrough. Wet pressure drop is measured at various flow rates.

Referring to FIG. 1, the apparatus 20 according to the present invention may be used in conjunction with a papermaking belt which yields a cellulosic fibrous structure having plural densities and/or plural basis weights. The papermaking belt and cellulosic fibrous structure may be made according to any of commonly assigned U.S. Pat. No. 4,191,609, issued Mar. 4, 1980 to Trokhan; U.S. Pat. No. 4,514,345, issued Apr. 30, 1985 to Johnson et al.; U.S. Pat. No. 4,528,239, issued Jul. 9, 1985 to Trokhan; U.S. Pat. No. 4,529,480, issued Jul. 16, 1985 to Trokhan; U.S. Pat. No. 5,245,025, issued Sep. 14, 1993 to Trokhan et al.; U.S. Pat. No. 5,275,700, issued Jan. 4, 1994 to Trokhan; U.S. Pat. No. 5,328,565, issued Jul. 12, 1994 to Rasch et al.; U.S. Pat. No. 5,334,289, issued Aug. 2, 1994 to Trokhan et al.; U.S. Pat. No. 5,364,504, issued Nov. 15, 1995 to Smurkoski et al.; U.S. Pat. No. 5,527,428, issued Jun. 18, 1996 to Trokhan et al.; U.S. Pat. No. 5,554,467, issued Sep. 18, 1996 to Trokhan et al.; and U.S. Pat. No. 5,628,879, issued May 13, 1997 to Ayers et al.

In another embodiment, the papermaking belt may be a felt, also referred to as a press felt as is known in the art, and as taught by commonly assigned U.S. Pat. No. 5,556,509, issued Sep. 17, 1996 to Trokhan et al. and PCT Application WO 96/00812, published Jan. 11, 1996 in the names of Trokhan et al., the disclosures of which patent and application are incorporated herein by reference.

Additionally, the paper dried on the micropore medium 40 according to the present invention may have multiple basis weights, as disclosed in commonly assigned U.S. Pat. No. 5,534,326, issued Jul. 9,1996 to Trokhan et al. and U.S. Pat. No. 5,503,715, issued Apr. 2, 1996 to Trokhan et al., the disclosures of which are incorporated herein by reference, or according to European Patent Application WO 96/35018, published Nov. 7, 1996 in the names of Kamps et al. The paper dried on the micropore medium 40 according to the present invention may be made using other papermaking belts as well. For example, prophetically, the belts disclosed in European Patent Application WO 97/24487, published Jul. 10, 1997 in the names of Kaufman et al. and European Patent Application 0 677 612 A2, published Oct. 18, 1995 in the names of Wendt et al. may be utilized. As well, other papermaking technologies may be utilized in conjunction with the papermaking machinery supporting and the paper made according to the micropore medium 40 of the present invention. Prophetically, suitable additional papermaking technologies include those disclosed in U.S. Pat. No. 5,411,636, issued May 2, 1995 to Hermans et al.; U.S. Pat. No. 5,601,871, issued Feb. 11, 1997 to Krzysik et al.; U.S. Pat. No. 5,607,551, issued Mar. 4, 1997 to Farrington, Jr. et al.; and European Patent Application 0 617 164, published Sep. 28, 1994, in the names of Hyland et al.

The embryonic web may be completely dried on the test fixture 50 according to the present invention. Alternatively, the embryonic web may be finally dried on a Yankee drying drum as is known in the art. Alternatively, the cellulosic fibrous structure may be finally dried without using a Yankee drying drum.

The cellulosic fibrous structure may be foreshortened as is known in the art. Foreshortening can be accomplished with a Yankee drying drum, or other cylinder, via creping with a doctor blade as is well known in the art. Creping may be accomplished according to commonly assigned U.S. Pat. No. 4,919,756, issued Apr. 24, 1992 to Sawdai, the disclosure of which is incorporated herein by reference. Alternatively or additionally, foreshortening may be accomplished via wet microcontraction as taught in commonly assigned U.S. Pat. No. 4,440,597, issued Apr. 3, 1984 to Wells et al., the disclosure of which is incorporated herein by reference.

What is claimed is:

1. A micropore medium for use with a through air drying papermaking apparatus, said medium having a pore size of less than or equal to 20 microns, said micropore medium having a wet pressure drop therethrough at a flow rate of 40 scfm per 0.087 square feet, of less than or equal to 4.0 inches of Mercury.

2. A medium according to claim 1 wherein said pressure drop is less than or equal to 3.5 inches of Mercury.

3. A medium according to claim 2 wherein said pressure drop is less than or equal to 3.0 inches of Mercury.

4. A micropore medium for use with a through air drying papermaking apparatus, said medium having a pore size of less than or equal to 20 microns, said micropore medium having a wet pressure drop therethrough at a flow rate of 80 scfm per 0.087 square feet, of less than or equal to 6.0 inches of Mercury.

5. A medium according to claim 4 wherein said pressure drop is less than or equal to 5.5 inches of Mercury.

6. A medium according to claim 5 wherein said pressure drop is less than or equal to 5.0 inches of Mercury.

7. A micropore medium for use with a through air drying papermaking apparatus, said micropore medium having a pore size of less than or equal to 20 microns and a wet pressure drop therethrough, said wet pressure drop increasing with increasing flow rate therethrough, said wet pressure drop being related to said flow rate by the general formula $$Y \leqq 0.048X+2.215$$

wherein X is the flow rate in scfm per 0.087 square feet and Y is the wet pressure drop in inches of Mercury.

8. The medium according to claim 7 wherein said pressure drop is related by the general formula $$Y \leqq 0.048X+2.015$$

wherein X is the flow rate in scfm per 0.087 square feet and Y is the wet pressure drop in inches of Mercury.

9. The medium according to claim 8 wherein said pressure drop is related by said general formula throughout the range of flow rates from 35 to 95 scfm per 0.087 square feet.

10. A process for making a tissue paper, said process comprising the steps of:

providing an embryonic web;

providing a micropore medium, said micropore medium having a pore size which provides a limiting orifice for air flow through said embryonic web, said medium having a pore size of less than or equal to 20 microns and a wet pressure drop therethrough, said wet pressure drop increasing with increasing flow rate therethrough, said wet pressure drop being related to said flow rate by the general formula $$Y \leqq 0.048X+2.215$$

wherein X is the flow rate in scfm per 0.087 square feet and Y is the wet pressure drop in inches of Mercury;

disposing said embryonic web on said micropore medium;

passing air through said embryonic web and said micropore medium, whereby said micropore medium is a limiting orifice for air flow through said embryonic web to thereby remove water from said embryonic web; and removing said embryonic web from said micropore medium.

11. A process according to claim 10 wherein said wet pressure drop is related to said flow rate by the general formula $$Y \leqq 0.048X+2.015$$

wherein X is the flow rate in scfm per 0.087 square feet and Y is the wet pressure drop in inches of Mercury.

12. A process according to claim 11 wherein said general formula occurs throughout the range of about 35 to about 95 scfm per 0.087 square feet.

13. A process according to claim 12 wherein said general formula occurs throughout the range of about 40 to about 80 scfm per 0.087 square feet.

* * * * *